US005462448A

United States Patent [19]

Kida et al.

[11] Patent Number: 5,462,448

[45] Date of Patent: Oct. 31, 1995

[54] ELECTRICAL CONNECTOR LOCKING SYSTEM

[75] Inventors: Jeffrey T. Kida, Layton; Alan D. Kendrick, Hooper, both of Utah

[73] Assignee: Morton International, Inc., Chicago, Ill.

[21] Appl. No.: 303,220

[22] Filed: Sep. 8, 1994

[51] Int. Cl.[6] ..... H01R 13/627

[52] U.S. Cl. ..... 439/357; 439/34; 280/735

[58] Field of Search ..... 439/345, 350, 439/353, 354, 357, 34; 280/728 R, 735, 741

[56] References Cited

U.S. PATENT DOCUMENTS

| | | | |
|---|---|---|---|
| 4,632,121 | 12/1986 | Johnson et al. | 439/357 X |
| 4,911,652 | 3/1990 | Savoca et al. | 439/135 X |
| 5,178,547 | 1/1993 | Bonas et al. | 439/34 |

*Primary Examiner*—Khiem Nguyen

*Attorney, Agent, or Firm*—George W. Rauchfuss, Jr.; Gerald K. White

[57] ABSTRACT

An initiator of an airbag assembly is coupled to an electrical connector that is connected to sensor circuitry of a vehicle containing the airbag assembly. A locking relationship is provided between the electrical connector and the initiator base having a pair of legs extending therefrom and having a plurality of male electrical terminals being positioned between the legs. Each of the legs has a radially inward protruding element having two tapered surfaces forming a ramp on each of the legs. The electrical connector has a plurality of female electrical terminals housed therein which mate with the male electrical terminals extending from the initiator base. The electrical connector also has radially inwardly extending notches positioned in the electrical connector, which notches are adapted to mesh essentially complementarily with and engage the protruding elements on the legs of the initiator base for locking the connector on the initiator base. The geometry of the locking relationship provides a retention or removal force substantially greater than the insertion force in mounting the electrical connector on the initiator base.

10 Claims, 2 Drawing Sheets

ELECTRICAL CONNECTOR LOCKING SYSTEM

FIELD OF THE INVENTION

This invention relates to an electrical connector for coupling an initiator of an airbag assembly to an electrical connector that is connected to the sensor circuitry of a vehicle, and more particularly to a locking system for such a connector requiring a lesser force for connecting and a substantially greater force for disconnecting the initiator and the electrical connector.

BACKGROUND OF THE INVENTION

In airbag restraint systems an airbag is inflated by receiving gas from an airbag inflator actuated by an initiator. The initiator has electrical terminals which are in contact with and receive electrical signals from vehicle circuitry generating an electrical signal when the vehicle decelerates above a predetermined rate. The electrical signal actuates the initiator and thereby the inflator which provides the gas for deploying the airbag.

A longstanding problem exists with the structure which physically maintains the electrical connector in electrical contact with the terminals of the initiator. A common prior art approach is to utilize arcuate ribs on the base of the initiator which mate with arcuate grooves in the body of a female connector on which the initiator base is mounted. Such structure is illustrated in FIG. 1 of this Application and is used in the electrical connector system shown and described in U.S. Pat. No. 5,178,547. Such prior art electrical connector structure is shown in more detail in FIGS. 3 to 6 of said U.S. Pat. No. 5,178,547. One problem with such structure is the low retention value of the arrangement which generally will require less force to disconnect the connector than is required to engage the connector. What is generally desired is a low connector insertion or engagement force as compared with a high retention force so that the connector, once engaged, remains connected regardless of such things as high vibration forces which are likely to occur in the operation of motor vehicles. Obviously, if the connector becomes disengaged by such external forces, the operation of the airbag system could become compromised.

SUMMARY OF THE INVENTION

Accordingly, it is an object of this invention to provide a new and improved electrical connector locking system for coupling an initiator of an airbag assembly to an electrical connector that is connected to sensor circuitry of a motor vehicle, which locking system physically maintains the electrical connector in electrical contact with the terminals of the initiator in an efficient, reliable manner and which does not substantially alter or impact the designs of the connector or initiator with which the locking arrangement is associated.

Still another object of the present invention is to provide a new and improved electrical connector locking system for coupling an initiator of an airbag assembly to an electrical connector which requires an insertion force which is substantially less than the force required for disengaging the connector from the initiator.

In carrying out this invention in one illustrative embodiment thereof, an electrical connector locking system for coupling an initiator of an airbag assembly to an electrical connector that is connected to sensor circuitry of a vehicle containing the airbag assembly is provided. An initiator base, having a pair of legs extending therefrom and having a plurality of male electrical terminals extending therethrough and being positioned between said legs, is provided with each of the legs having a radially inwardly protruding element having tapered surfaces forming a ramp on each of the legs. An electrical connector having a plurality of female electrical terminals housed therein is adapted to mate with the male electrical terminals extending from the initiator base. Radially inwardly extending notches positioned in the electrical connector are adapted to essentially complementarily mesh with and engage the protruding elements of the legs of the initiator base for thereby locking the connector on the initiator base.

BRIEF DESCRIPTION OF THE DRAWINGS

The invention, together with further objects, features, advantages and aspects thereof, will be more clearly understood from the following description taken in connection with the accompanying drawings.

DESCRIPTION OF THE PREFERRED EMBODIMENTS

The present invention is directed to an electrical connector locking system for coupling an initiator of an airbag assembly to an electrical connector that is connected to sensor circuitry of a vehicle containing an airbag assembly. The particular type of initiator, airbag assembly and sensor circuitry of a vehicle in which the airbag assembly is mounted are known in the art and, accordingly, are not described in detail as they do not in themselves constitute features of the present invention. Only the electrical connector locking system in which the invention resides will be described in detail.

Figure 2:
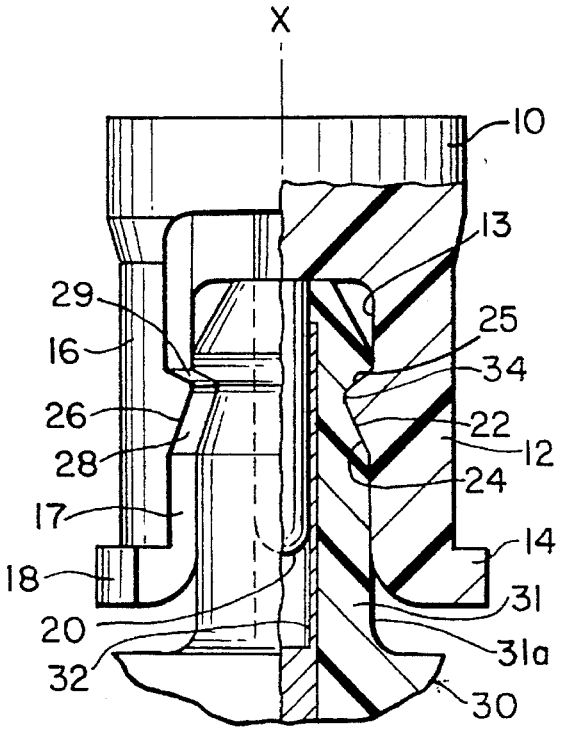
FIG. 2 is a partial cross-sectional, elevational view of the electrical connector locking system in accordance with the present invention, with part of the electrical connector portion omitted for purposes of better illustrating the invention.
Figure 3:
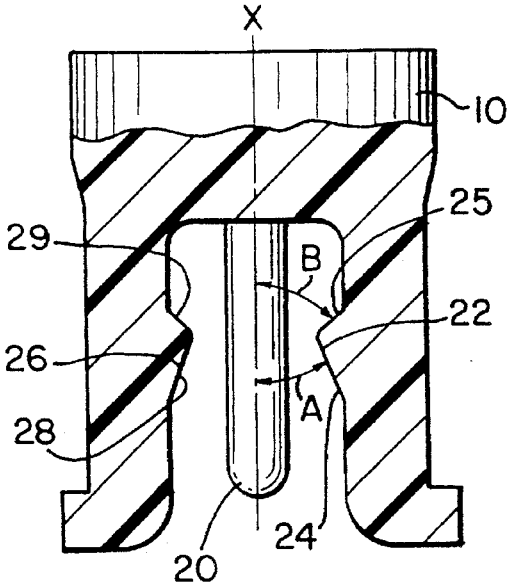
FIG. 3 is a partial cross-sectional, elevational view of the initiator base portion of the connector locking system as shown in FIG. 2.

Referring now to FIG. 2, a generally circular initiator base 10 having conventional initiator structure mounted thereon (not shown) has a pair of radially opposed legs 12 and 16 extending axially downwardly therefrom in the same direction, with each leg terminating at its distal end in a radially outwardly extending foot 14 and 18, respectively. A plurality of male electrical terminals 20 extend axially downwardly from the base 10 between the radially opposed legs 12 and 16 (also see FIG. 3). Leg 12, on its radially inward surface 13, has a radially inwardly protruding element 22 having two tapered surfaces 24 and 25, said two tapered surfaces being tapered radially inwardly and converging together thereby forming a ramp on leg 12. Similarly, leg 16 also has, on its radially inward surface 17, a radially inwardly protruding element 26 thereon having two tapered surfaces 28 and 29, said two tapered surfaces also being tapered radially inward and converging toward each other and thereby forming a ramp on leg 16. Accordingly, radially inwardly protruding ramp elements 22 and 26 are diametrically opposed to each other and positioned on radially opposite sides of the male electrical terminals 20.

An electrical connector element indicated generally by reference numeral 30 comprises a base end 30*a* and an insertion end 30*b* joined by an intermediate projecting portion 31 adapted to be received by the initiator base 10. The electrical connector element 30 has a plurality of, generally two, female electrical terminals in the form of metal sleeves 32 housed in the projecting portion 31 thereof and open at the insertion end 30*h* of the connector element. When connector element 30 is locked to initiator base 10, the metal sleeves 32 are adapted to mate with and receive the male electrical terminals 20 extending from the initiator base 10. Accordingly, when the connector element 30 is inserted or plugged into the initiator base 10, electrical contact is made between the male terminals 20 and the female electrical terminals 32 which are connected to the sensor circuitry of the vehicle containing the airbag assembly.

Figure 4:
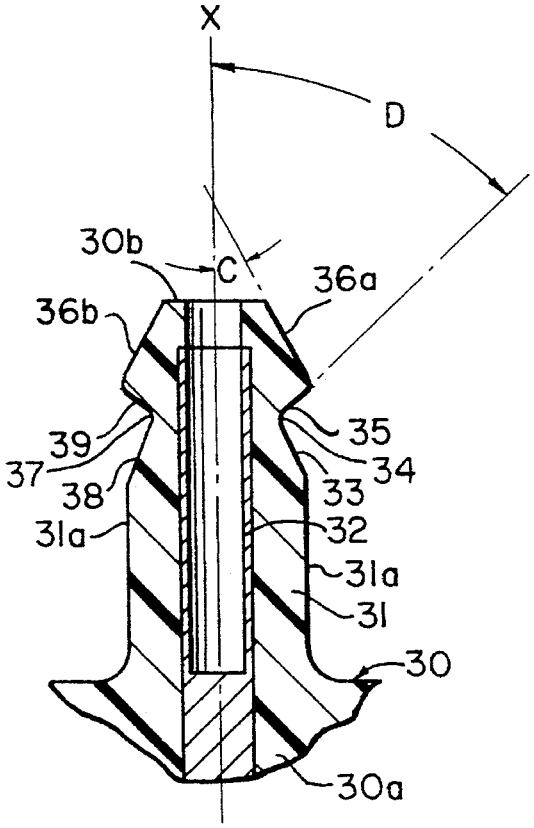
FIG. 4 is a partial cross-sectional, elevational view of the electrical connector portion of the connector locking system illustrated in FIG. 2.

The projecting portion 31 of electrical connector 30 is provided with radially inwardly extending notches 34 and 37 (see also FIG. 4) which are adapted to mesh with and engage the protruding ramp elements 22 and 26, respectively, of the initiator base 10 for locking the connector 30 on the initiator base 10 as is partially shown in FIG. 2.

Radially inwardly extending notches 34 and 37 of electrical connector element 30 are formed on the radially outward surface 31*a* of projecting portion 31 of the electrical connector to be complementary to protruding elements 22 and 26 of the inflator base 10. Notch 34 is formed by two converging tapered surfaces 33 and 35, said two tapered surfaces being tapered radially inwardly from outer surface 31*a* and converging to form notch 34 which is complementary in shape to protruding element 22. Similarly, notch 37 is formed by two converging tapered surfaces 38 and 39, said two tapered surfaces being tapered radially inwardly from outer surface 31*a* and converging to form notch 37 which is complementary in shape to protruding element 26. It will be appreciated that although the two notches 34 and 37 are described as separate notches on outer surface 31*a*, said notches may, if desired, be two portions of a continuous circular notch around connector 30.

To enable electrical connector 30 to be readily inserted into initiator base 10 connector surface 31*a* tapers radially inwardly from notches 34 and 37 to insertion end 30*b* of the connector to provide radially inwardly tapered insertion surfaces 36*a* and 36*b*. Again, it will be appreciated that although the two insertion surfaces 36*a* and 36*b* are described as separate surfaces on outer surface 31*a*, said insertion surfaces may, if desired, be two portions of a continuous circular insertion surface around connector 30, especially when the two notches 34 and 37 are two portions of a continuous circular notch.

The purpose of the mating and interlocking protruding elements 22 and 26 and their complementary notches 34 and 37 is to lock the connector 30 in position on the initiator base 10. The ultimate purpose, of course, is to physically maintain electrical connection between the initiator and the vehicle circuitry so as not to compromise the operation of the airbag system. The requirements are for providing a larger force for extracting the connector 30 and female terminals 32 from the male electrical terminals 20 than is required to insert the connector 30 and female terminals on the male electrical terminals 20 in the initiator base 10.

By controlling the slope or angle of tapered surfaces 24, 25, 28 and 29 of the projecting elements 22 and 26, the slope or angle of tapered surfaces 33, 35, 38 and 39 of notches 34 and 37 and the slope or angle of insertion surface 36 with respect to the axial axis X of the locking mechanism, the insertion and extraction values can be customized to meet the specification of a particular locking system and ensure that the extraction force is significantly greater than the insertion force.

The insertion force is generally controlled primarily by the angle A of tapered surfaces 24 and 28 of ramp elements 22 and 26 and the angle C of tapered insertion surfaces 36*a* and 36*b* of connector 30. The extraction force is generally controlled by the angle B of tapered extraction surfaces 25 and 29 of ramp elements 22 and 26 and the generally equivalent angle D of tapered extraction surface 35 and 39 of notches 34 and 37, respectively.

Insertion surface angles A and C will generally be within the range of from about 15° to about 25°, preferably from about 20° to about 22°. Extraction surface angles B and D will generally be in the range of from about 30° to about 80°, preferably from about 40° to about 75°, and most preferably is about 42° to about 44°.

Figure 1:
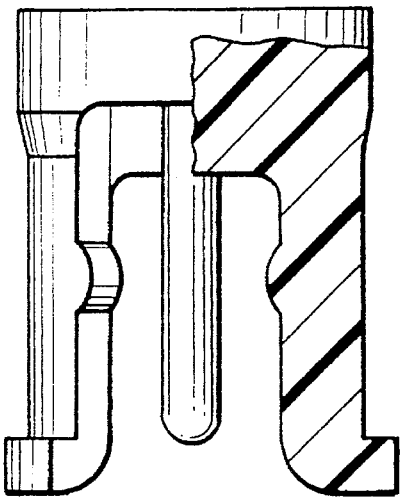
FIG. 1 PRIOR ART
FIG. 1 is a partial cross-sectional, elevational view of an initiator base illustrating the arcuate rib electrical connector engagement structure employed in the prior art.

In order to demonstrate the improved mechanical performance of the electrical connector locking system in accordance with the present invention compared to the prior art arcuate rib-arcuate groove locking system, reference is made to Table I which summarizes a plurality of measurements made on a prior art type connector, as shown in FIG. 1 and described in U.S. Pat. No. 5,178,547, and Table II which contains test data on a plurality of measurements on the locking arrangement of five locking devices of the present invention.

TABLE I

| | (Prior Art) | |
|---|---|---|
| Prior Art Type Connector | Insertion Push (lbs.) | Extraction Pull (lbs.) |
| Average of 2968 measurements | 8.6797 | 8.2534 |
| Std. Deviation | 2.2273 | 2.1823 |

The locking arrangements of this invention for which data is provided in Table II had insertion angles A and C of 20° to 22° and extraction angles B and D of 42° to 44°.

TABLE II

| | (Invention) | |
|---|---|---|
| Locking Connector No. | Insertion Push (lbs.)/ Standard Deviation Average of five measurements | Extraction Pull (lbs.)/ Standard Deviation Average of five measurements |
| 1 | 23.88/4.61 | 28.30/0.93 |
| 2 | 19.20/1.88 | 27.80/1.34 |
| 3 | 18.76/2.18 | 27.78/1.64 |
| 4 | 17.86/0.67 | 27.34/1.44 |
| 5 | 18.14/2.44 | 27.18/1.47 |

It will be seen from a comparison of the aforesaid data that the insertion force required on the present invention is more than twice that required by the prior art type construction while the extraction value is increased more than three times of that of the prior art construction thereby solving the longstanding problem of low retention values for the connection structure. It is noted that in the present invention the extraction force is at least 50% greater than that of the insertion force. Note that the prior art provides less extraction force than the insertion force which is an undesirable feature because mechanical problems such as vibration can cause the connection to loosen and thus fail to maintain the electrical contact required for properly operating an airbag assembly.

Accordingly, a very simple locking structure provides a solution to a longstanding problem of low retention values that previously existed in maintaining an electrical connection in the initiator interface with the vehicle circuitry. In addition, the invention has little impact on the overall connector and initiator design and structure. Flexibility is provided by altering the geometry of the connector to initiator interface to provide insertion and retention values customized to meet the application requirements.

Since other requirements and environments varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

We claim:

1. An electrical connector locking system for coupling an initiator of an airbag assembly to an electrical connector that is connected to the circuitry of a vehicle containing the airbag assembly, the locking system comprising:

an initiator base having a pair of radially opposed legs extending axially in the same direction therefrom and having a plurality of male electrical terminals extending axially therethrough and being positioned between said legs, each of said legs having on a radially inward surface of said legs a radially inwardly protruding ramp element, each of said protruding ramp elements formed by two converging tapered surfaces tapered radially inwardly and converging together;

an electrical connector comprising a base and an insertion end joined by a projecting portion adapted to be received by the initiator base, a plurality of female electrical terminals housed in said projecting portion of said connector, said female terminals adapted to mate with the male electrical terminals extending from said initiator base, said electrical connector having, on a radially outward surface of said projecting portion, a pair of radially inwardly extending notches, each of said notches formed by two converging tapered surfaces tapered inwardly from said radially outward surface, each of said notches being substantially complementary in shape to the protruding ramp elements on the legs of said initiator base, each of said notches meshing with and engaging one of said protruding ramp elements on one of said legs of said initiator base for locking said connector on said initiator base, said projecting portion tapers radially inwardly from said notches toward the insertion end of the electrical connector to provide a radially inwardly tapered insertion surface.

2. An electrical connector locking system as claimed in claim 1 wherein said projecting portion tapering radially inwardly from said notches toward the insertion end of the electrical connector provides a radially inwardly tapered continuous circular insertion surface.

3. An electrical connector locking system as claimed in claim 2 wherein said ramps on said legs, said notches on said electrical connector and said radially inwardly tapered continuous circular insertion surface are configured geometrically such that a greater force is required to remove said connector from said initiator base than a force required to insert the electrical connector on said base.

4. An electrical connector locking system as claimed in claim 3 wherein the force required to remove the electrical connector from the initiator base is at least approximately 50% greater than the force required to insert said connector on said base.

5. An electrical connector locking system as claimed in claim 2 wherein one of the two tapered surfaces of each notch comprises an extraction surface and the continuous circular insertion surface has an axial angle within the range of from about 15° to about 25° and the extraction surfaces have an axial angle within the range of from about 30° to about 80°.

6. An electrical connector locking system as claimed in claim 4 wherein one of the two tapered surfaces of each notch comprises an extraction surface and the continuous circular insertion surface has an axial angle within the range of from about 15° to about 25° and the extraction surfaces have an axial angle within the range of from about 30° to about 80°.

7. An electrical connector locking system as claimed in claim 5 wherein the axial angle of the continuous circular insertion surface is within the range of from about 20° to about 22° and the axial angle of the extraction surfaces is within the range of from about 42° to about 44°.

8. An electrical connector locking system as claimed in claim 6 wherein the axial angle of the continuous circular insertion surface is within the range of from about 20° to about 22° and the axial angle of the extraction surfaces is within the range of from about 42° to about 44°.

9. An electrical connector locking system as claimed in claim 1 wherein one of the two tapered surfaces of each notch comprises an extraction surface and the insertion surface has an axial angle within the range of from about 15° to about 25° and the extraction surfaces have an axial angle within the range of from about 30° to about 80°.

10. An electrical connector locking system as claimed in claim 9 wherein the axial angle of the insertion surface is within the range of from about 20° to about 22° and the axial angle of the extraction surfaces is within the range of from about 42° to about 44°.

* * * * *